US006530531B2

(12) United States Patent
Butler

(10) Patent No.: US 6,530,531 B2
(45) Date of Patent: Mar. 11, 2003

(54) RISER TUBE WITH SLOTTED RATCHET GEAR FOR POP-UP IRRIGATION SPRINKLERS

(75) Inventor: David C. Butler, Ogden, UT (US)

(73) Assignee: Orbit Irrigation Products, Inc., North Salt Lake, UT (US)

( * ) Notice: Subject to any disclaimer, the term of this patent is extended or adjusted under 35 U.S.C. 154(b) by 0 days.

(21) Appl. No.: 09/928,845

(22) Filed: Aug. 12, 2001

(65) Prior Publication Data

US 2002/0066800 A1 Jun. 6, 2002

Related U.S. Application Data

(60) Provisional application No. 60/224,759, filed on Aug. 12, 2000.

(51) Int. Cl.[7] ..... B05B 15/10

(52) U.S. Cl. ..... 239/205; 239/200; 239/201; 239/203; 239/204

(58) Field of Search ..... 239/200, 201, 239/202, 203, 204, 205, 206, 210, 207

(56) References Cited

U.S. PATENT DOCUMENTS

| | | | | |
|---|---|---|---|---|
| 1,833,040 A | * | 11/1931 | Rader | 239/201 |
| 3,317,144 A | * | 5/1967 | Muschett | 239/204 |
| 3,921,910 A | * | 11/1975 | Hayes et al. | 239/205 |
| 4,220,283 A | | 9/1980 | Citron | |

* cited by examiner

*Primary Examiner*—Robin O. Evans
(74) *Attorney, Agent, or Firm*—Mallinckrodt & Mallinckrodt; Robert R. Mallinckrodt

(57) ABSTRACT

A pop-up sprinkler of the type that includes a riser that moves upwardly out of a sprinkler housing when water pressure is applied and that allows manual adjustment of the angular orientation of the riser with respect to the housing to adjust angular orientation of the spray from the sprinkler, and provides for such angular adjustment by having a toothed flange associated with the riser in the housing which engages tabs associated with the housing, provides for longer life of the toothed flange and/or the tabs by providing slots extending radially inwardly in the toothed flange to reduce its rigidity to the extent that the teeth and/or tabs do not wear as quickly.

19 Claims, 1 Drawing Sheet

RISER TUBE WITH SLOTTED RATCHET GEAR FOR POP-UP IRRIGATION SPRINKLERS

RELATED APPLICATIONS

Figure 1:
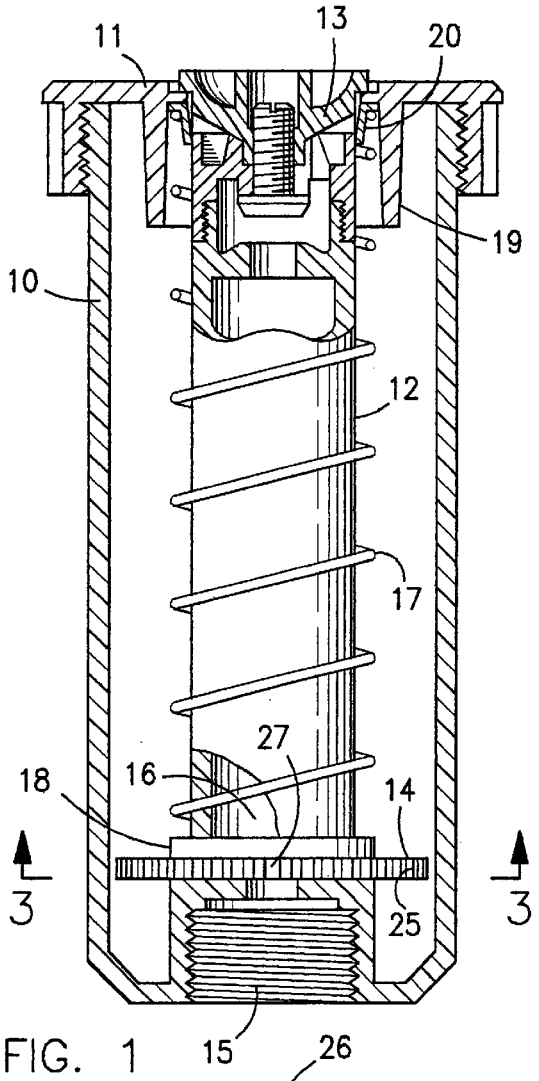

This application claims the benefit of Provisional Application Ser. No. 60/224,759, filed Aug. 12, 2000, and entitled Riser Tube With Slotted Ratchet Gear For Pop-Up Irrigation Sprinklers.

BACKGROUND OF THE INVENTION

1. Field

The invention is in the field of pop-up irrigation sprinklers which allow for manual adjustment of the angular relationship of the riser and housing.

2. State of the Art

Irrigation systems, such as turf watering systems, are used extensively, particularly in arid and semiarid areas of the world, such as the western portion of the United States. The typical modem turf watering system consists of a plurality of pop-up sprinklers spaced according to the range of the sprinklers so as to cover the entire turf area. Individual sprinklers are fed by underground water pipes connected to a water supply source through electrically operated valves and retract during periods of non-watering so as not to be obstructions to the normal daily activities. The sprinklers are typically organized into groups or zones such that several individual sprinklers in a particular area of the turf are controlled by a single valve, with several separately controlled groups or zones required to cover the entire turf area. Typically, only one zone is watered at a time to ensure sufficient pressure to operate the sprinklers in the zone.

The direction of water spray from such sprinklers is obviously important so as to provide water where needed, but not to those areas where not needed or wanted, such as to roads, parking lots, sidewalks, and against buildings. This aiming of the spray is typically accomplished by turning the sprinkler housing with respect to the water supply pipe to which it is attached, by turning the water supply pipe with respect to an up stream connection of such pipe, or a combination of both. However, such turning can loosen the housing or supply pipe causing it to leak. Some pop-up sprinklers are available were the riser tube which rises from the sprinkler housing is rotatable with respect to the housing to aim the spray of water where needed. This rotatability can be accomplished in various ways. One way is to provide a lower gear or flange having fine teeth about the outer perimeter thereof as part of the riser tube and a plurality of mating internally directed tabs such as in the form of splines which extend longitudinally along the length of the housing in which the riser longitudinally slides to engage such teeth. As the riser tube rises and falls during use, the orientation of the spray nozzle attached at the upper end thereof is maintained due to the engagement of the teeth with the splines, the inwardly directed edges of the splines typically being pointed to fit in the grooves between the teeth. The riser tube may be forcibly rotated, slightly flexing the splines, the teeth, or both, to skip the teeth past the splines to allow angular repositioning of the riser tube with respect to the housing to thereby reposition the direction of spray from the spray nozzle. This process wears out the teeth and/or the splines over a relatively short period of time resulting in loss of the rotationally locking function. A repositioning system for pop-up sprinklers as described, as well as other specific embodiments are disclosed in U.S. Pat. No. 4,220,283 issued to Citron, which disclosure is hereby incorporated by reference.

SUMMARY OF THE INVENTION

The invention comprises a pop-up sprinkler of the type having a housing with a lower end for connection to a water supply with an opening therethrough for admitting water, and an opening through an upper end thereof for closely passing a riser tube. A riser tube is slidably and rotatably engaged within the housing with an upper end thereof which extends through an opening through the upper end thereof, with a spray nozzle mounted thereto. A compression spring engages the upper portion of the housing and the a lower portion of the riser tube to maintain the riser tube in a retracted position until water is admitted through the opening in the lower portion of the housing, acting against a lower, radially outwardly extending annular flange of the riser tube. A plurality of internally directed splines of the housing extend longitudinally therethrough, having respective sharpened, inwardly directed edges which engage radially outwardly extending teeth peripherally disposed about the flange of the riser tube, forming a gear. A plurality of inwardly radially directed slots in the flange allow the flange to flex slightly so as to minimize the shearing and other stresses between the splines and teeth during forcible changes in rotational orientation therebetween during re-aiming of the riser tube and nozzle. This dramatically increases the wear life of the gear teeth and the splines over non-slotted gear designs. Preferably, three or six equally spaced splines are used with four equally spaced slots such that all of the splines do not simultaneously engage a slot, which condition would possibly create more rotational vibration and movement during use than desired.

THE DRAWINGS

Figure 2:
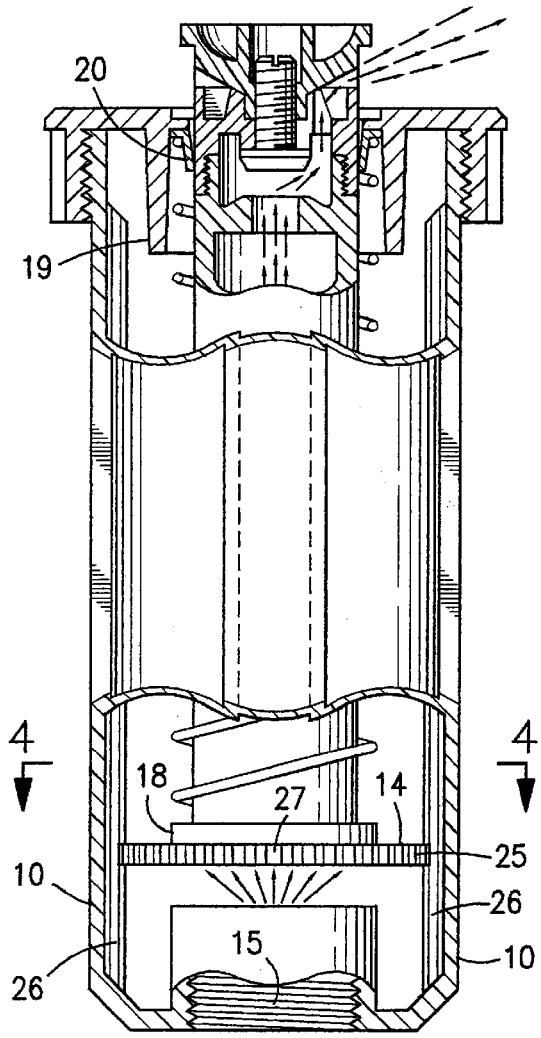
Figure 3:
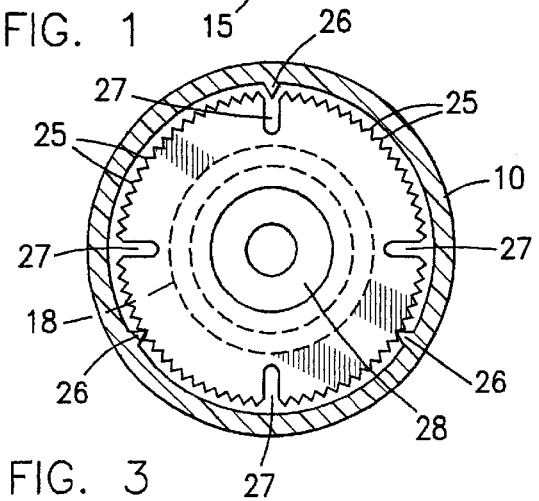
Figure 4:
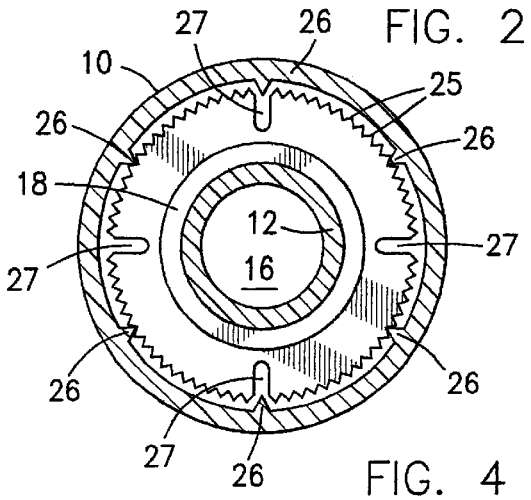

The best mode presently contemplated for carrying out the invention is illustrated in the accompanying drawings, in which:

FIG. 1 is a longitudinal vertical sectional view of a pop-up sprinkler of the invention having three splines;

FIG. 2, a view corresponding to FIG. 1, but having six splines and wherein water is being admitted thereinto causing the riser tube to elevate;

FIG. 3, a lateral horizontal sectional view taken on the line 3—3 of FIG. 1 showing the bottom of the lower portion of the riser tube with the flange with teeth which engage the three splines; and FIG. 4, a lateral horizontal sectional view taken on the line 4—4 of FIG. 2 showing the lower portion of the riser tube showing the flange with teeth which engage the six splines.

DETAILED DESCRIPTION OF THE ILLUSTRATED EMBODIMENT

FIGS. 1 and 2 show a typical pop-up sprinkler construction. Such a sprinkler includes a generally cylindrical housing 10 with cap 11 threaded to the top thereof and a generally cylindrical, sometimes slightly tapered, riser 12 which extends through a central opening in cap 11. Riser 12 includes a nozzle 13 at the upper end thereof and a flange 14 at the lower end thereof. An internally threaded opening 15 in the bottom of housing 10 provides for attachment to an externally threaded water supply pipe, not shown, and allows water from the supply pipe to flow into housing 10. Riser 12 has an internal passage 16 therethrough to allow flow of water from housing 10 to and through nozzle 13. A coil spring 17 extends around riser 12 with one end against body cap 11 and its opposite end against flange 18 above flange 14 and around riser 12 so that spring 17 biases riser 12 to its retracted position in housing 10 as shown in FIG. 1.

As water under pressure enters housing 10 through opening 15, it acts on the surface area of riser 12 and attached nozzle 13 and causes riser 12 to rise upwardly in housing 10 against the bias of spring 17. FIG. 2 shows riser 12 as it starts to rise in housing 10. At the full extent of its travel, riser 12 will travel upwardly until such travel is stopped by flange 14 hitting against ring 19 extending downwardly from cap 11. Flange 18 fits just inside the bottom portion of ring 19 to help form a seal. Further seals, such as seal 20 extending from cap 11 around riser 12, may be provided. Such pop-up sprinkler construction is well known to persons skilled in the art so will not be described further.

Most pop-up sprinklers have the rotational position of the riser fixed with respect to the housing. To adjust the direction of spray for a nozzle with less than full spray, such as a one-quarter spray pattern or a one-half spray pattern, the sprinkler housing as threaded onto a water supply pipe in opening 15 is rotated, either tightening or loosening the sprinkler housing 10 with respect to the supply pipe, or the supply pipe itself is rotated, thereby tightening or loosening the supply pipe in a connection up line from the sprinkler. While small changes in angular orientation of the sprinkler can be made this way, there is a limit to how much the sprinkler housing or supply pipe can be rotated before a joint begins to leak.

Some pop-up sprinklers have a feature that allows the riser to be rotated with respect to the housing. For this purpose, in the pop-up sprinkler of the invention, flange 14 extending from the lower portion of riser 12 has gear or similar teeth 25, FIGS. 3 and 4, around its circumference. Longitudinally extending splines 26, FIGS. 2–4, extend inwardly from the housing 10 inside the housing to engagement with teeth 25 on flange 14 as shown in FIGS. 3 and 4. Longitudinally extending splines 26 extend from a location below the location of flange 14 with riser 12 in retracted position upwardly in the housing 10 to a position above the location of flange 14 when riser 12 is in fully extended position. In this way, splines 26 remain engaged with teeth 25 through the full range of travel of riser 12 to maintain and hold riser 12 in fixed angular position with respect to housing 12. Splines 26 and teeth 25 are designed to slip over one another when rotational pressure is applied to the riser with respect to the housing. Thus, when it is desired to adjust the rotational orientation of the nozzle 13 without tightening or loosening housing 10 with respect to a water supply pipe or other piping, riser 12 is manually rotated with respect to housing 10 causing rotation of flange 14 with respect to housing 10 and splines 26, moving teeth 25 to a new position with respect to splines 26. This type of arrangement is shown and described in U.S. Pat. No. 4,220,283, particularly for the embodiment shown in FIG. 16 thereof. However, this relative movement of the teeth and splines causes substantial wear to the softer of the teeth or spline or to both teeth and spline.

To substantially lessen the wear that occurs to teeth 25 and/or splines 26 as the teeth 25 are moved over splines 26, the invention provides inwardly extending slots 27 spaced circumferentially around flange 14 as shown in FIGS. 3 and 4. These slots 27 have unexpectedly been found to lessen the rigidity of flange 14 to the extent that substantially less wear occurs on teeth 25 and splines 26 as they move over one another as riser 12 is rotated with respect to housing 10, thereby substantially increasing the useful life of the adjustment feature of the sprinkler, and, because the sprinkler loses its usefulness if it cannot hold an adjustment, the useful life of the sprinkler. It has been found that four slots 27 spaced at ninety degree intervals around the flange 14 is very effective, although less than four slots or greater than four slots could be used. Further, it has been found that extending the slots 27 inwardly to the extent that flange 14 extends beyond its mounting to riser 12, i.e., beyond the edge of flange 18, works satisfactorily. This distance is about one-half the radial thickness of flange 14, i.e., the distance from the outer edge of opening 28, FIG. 3, in flange 14, which generally will be the same diameter as passage 16 through riser 12, and the outer edge of flange 14 which forms teeth 25. Longer or shorter slots 27 could be used as long as such slots lessen the rigidity of flange 14 to an extent to lessen the wear on teeth 25 and/or splines 26 when the two are rotated with respect to each other.

When four slots 27 arranged evenly at ninety degree intervals around flange 14 are used, it is preferred that splines 26 be arranged other than at ninety degree intervals so that there is no position where all splines line up with slots. Using three splines 26 spaced evenly at one hundred twenty degree intervals around the inside of housing 10, as shown in FIG. 3, ensures that there will always be at least two splines 26 engaging teeth 25 rather than aligned with a slots 27. Using six splines 27 evenly spaced at sixty degree intervals around the inside of housing 10, as shown in FIG. 4, ensures that there will always be at least four splines engaging teeth 25 rather than slots 27. The arrangement of splines will depend upon the arrangement of slots. While it is not necessary that at least one spline always engage teeth 25, it is preferred to ensure the angular orientation of riser 12 is held securely. This condition of always having at least one spline engaging a tooth can be met by making the number of splines different than the number of slots and arranging each evenly around the housing or flange, respectively. Alignment of all splines in slots is not presently preferred because it could allow some angular play of riser 12 and possibly some unwanted vibration. However, this generally will not be a problem.

While the invention has been described with respect to an embodiment having longitudinally extending splines extending inwardly from the housing walls to engage teeth in a flange extending outwardly toward the housing from the riser, the flange teeth could be engaged and held by tabs extending into engagement with the flange teeth from a ring or other structure associated with the housing and generally held in stationary rotational position with the housing, but slidable in the housing such as structures shown in U.S. Pat. No. 4,220,283 previously referred to. In such cases, the flange slots of the invention can also provide advantageous increases in tooth or tab life.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A pop-up sprinkler comprising:

a housing with a lower end for connection to a water supply;

an opening in the lower end to permit the flow of water into the housing;

an opening in an upper end opposite the lower end;

a riser slidably and rotatably engaged within the housing and in the opening in the upper end of the housing to substantially close the upper end;

a spring between the housing and the riser to bias the riser to a retracted position in the housing;

a spray nozzle in an upper end of the riser;

a flow passage in the riser to allow water to flow from the housing to the nozzle;

surface area on the riser sufficient to cause the riser to move upwardly against the force of the spring to move the nozzle outwardly of the housing when water of a predetermined pressure enters the housing through the opening in the lower end of the housing;

an annular riser flange extending from the riser within the housing toward the housing and having a radial thickness with teeth about the circumference thereof;

tabs associated with the housing which engage circumferential teeth of the annular riser flange to hold the riser in a selected position with respect to the housing when the riser is manually rotated to a selected position with respect to the housing; and slots extending radially inwardly from the circumference of the annular riser flange a distance less than the radial thickness of the flange and sufficient to reduce the rigidity of the flange to ease movement of the flange with respect to the engaging tabs.

2. A pop-up sprinkler according to claim 1, wherein the tabs are longitudinally extending splines extending along the inside of the housing a distance to engage the engaged teeth of the annular riser flange throughout travel of the annular riser flange during upward movement of the riser in the housing.

3. A pop-up sprinkler according to claim 2, wherein the number of splines is different than the number of slots.

4. A pop-up sprinkler according to claim 3, wherein there are four slots in the annular riser flange.

5. A pop-up sprinkler according to claim 4, wherein there are three splines.

6. A pop-up sprinkler according to claim 4, wherein there are six splines.

7. A pop-up sprinkler according to claim 4, wherein the slots extend inwardly about one half the radial thickness of the flange.

8. A pop-up sprinkler according to claim 1, wherein the number of tabs is different than the number of slots.

9. A pop-up sprinkler according to claim 8, wherein there are four slots in the annular riser flange.

10. A pop-up sprinkler according to claim 9, wherein there are three tabs.

11. A pop-up sprinkler according to claim 9, wherein there are six tabs.

12. A pop-up sprinkler according to claim 9, wherein the slots extend inwardly about one half the radial thickness of the flange.

13. A pop-up sprinkler according to claim 1, wherein the slots extend inwardly about one half the radial thickness of the flange.

14. In a pop-up sprinkler having:

a housing with a lower end for connection to a water supply;

an opening in the lower end to permit the flow of water into the housing;

an opening in an upper end opposite the lower end;

a riser slidably and rotatably engaged within the housing and in the opening in the upper end of the housing to substantially close the upper end;

a spring between the housing and the riser to bias the riser to a retracted position in the housing;

a spray nozzle in an upper end of the riser;

a flow passage in the riser to allow water to flow from the housing to the nozzle;

surface area on the riser sufficient to cause the riser to move upwardly against the force of the spring to move the nozzle outwardly of the housing when water of a predetermined pressure enters the housing through the opening in the lower end of the housing;

an annular riser flange extending from the riser within the housing toward the housing and having a radial thickness with teeth about the circumference thereof; and tabs associated with the housing which engage circumferential teeth of the annular riser flange to hold the riser in a selected position with respect to the housing when the riser is manually rotated to a selected position with respect to the housing;

the improvement comprising:

slots extending radially inwardly from the circumference of the annular riser flange a distance less than the radial thickness of the flange and sufficient to reduce the rigidity of the flange to ease movement of the flange with respect to the engaging tabs.

15. An improvement to pop-up sprinklers according to claim 14, wherein the number of slots is different than the number of tabs.

16. An improvement to pop-up sprinklers according to claim 15, wherein there are four slots.

17. An improvement to pop-up sprinklers according to claim 16, wherein there are three tabs.

18. An improvement to pop-up sprinklers according to claim 16, wherein there are six tabs.

19. An improvement to pop-up sprinklers according to claim 14, wherein the slots extend inwardly about one half the radial thickness of the flange.

* * * * *